United States Patent [19]

Adams

[11] Patent Number: 4,869,208

[45] Date of Patent: Sep. 26, 1989

[54] COMPACT MODULAR FLUID STORAGE AND HEATING SYSTEM

[75] Inventor: Charles L. Adams, Euless, Tex.

[73] Assignee: PVI Industries, Inc., Fort Worth, Tex.

[21] Appl. No.: 913,348

[22] Filed: Sep. 30, 1986

Related U.S. Application Data

[63] Continuation-in-part of Ser. No. 765,075, Aug. 13, 1985, abandoned.

[51] Int. Cl.[4] ..... F22B 7/00; F22B 25/00

[52] U.S. Cl. ..... 122/214; 122/17; 122/136 R

[58] Field of Search ..... 126/362, 437; 122/17, 122/20 B, 136 R, 214; 237/19, 8 R, 56, 55, 66

[56] References Cited

U.S. PATENT DOCUMENTS

| | | | |
|---|---|---|---|
| 2,522,091 | 9/1950 | Burwell . | |
| 3,175,075 | 3/1965 | Nord et al. | 122/214 |
| 3,349,754 | 6/1966 | Bock . | |
| 3,987,761 | 10/1976 | Downs et al. . | |
| 4,409,928 | 10/1983 | Tursi et al. | 110/234 |
| 4,438,728 | 3/1984 | Fracaro | 126/362 |
| 4,526,112 | 7/1985 | Warner . | |
| 4,550,710 | 11/1985 | McDonald | 126/362 |
| 4,641,606 | 2/1987 | Roberts | 122/214 |

*Primary Examiner*—Henry Bennett

*Attorney, Agent, or Firm*—Charles D. Gunter, Jr.

[57] ABSTRACT

A modular fluid storage and heating system is provided which includes a plurality of different, interconnectable tank components of standardized dimensions such as fluid storage tanks, closure caps, and heater assemblies. Each of the tank components is sufficiently compact in size to pass through standard-sized corridors and doorways to permit assembly on site of a fluid storage and heating system configured specifically to the needs of a particular user. Because each of the tank components is of a standard size, fluid storage and heating systems may be constructed from standard-sized rather than from custom-sized components, thereby reducing considerably the expense and time associated with construction of such systems.

8 Claims, 6 Drawing Sheets

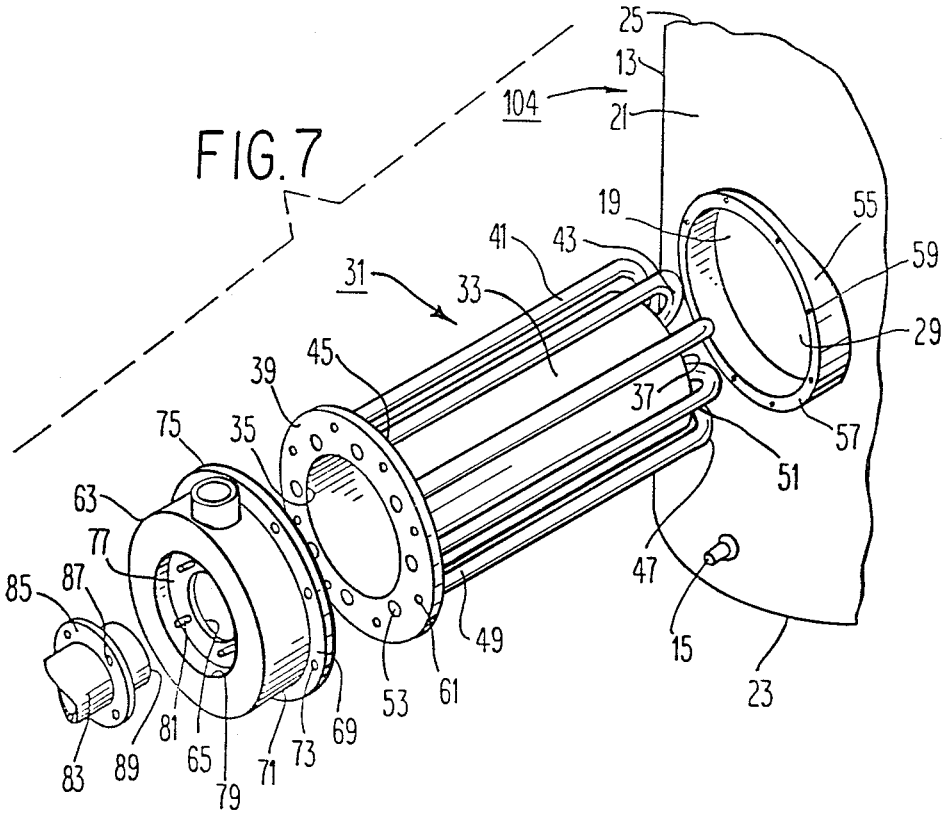
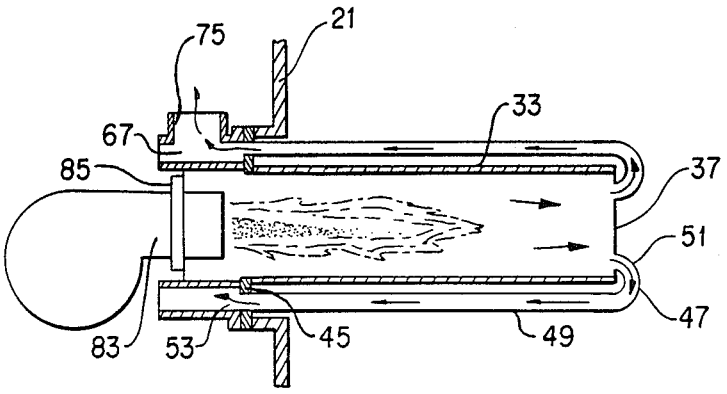
FIG. 8

COMPACT MODULAR FLUID STORAGE AND HEATING SYSTEM

CROSS-REFERENCE TO RELATED APPLICATION

This application is a continuation-in-part of my prior U.S. patent application Ser. No. 765,075 filed Aug. 13, 1985 now abandoned.

FIELD OF THE INVENTION

This invention relates to fluid storage and heating tanks.

BACKGROUND AND OBJECTS OF THE INVENTION

A common problem faced by installers of fluid storage and heater tanks of large capacity is that limited means of access is provided to the room in which the fluid storage and heater tanks are to be installed. Typically, buildings and rooms have doors of standard width, commonly 32, 36, 48, or 72 inches, and this limits the size, and thus the capacity, of the storage tanks which can be installed.

It is, of course, usually possible to simply multiply the fluid heater and storage tank assemblies. Thus, one can obtain, for example, 100 gallon capacity by providing two complete 50 gallon hot water heaters. This solution is undesirable, of course, because then one has to have plural burners, which adds to the expense of the installation. See, e.g., U.S. Pat. Nos. 3,265,041 to McCarthy, Jr., and 4,023,558 to Lazaridis. Also, duplicative controls are required, which further adds to the cost of installation and maintenance. Moreover, the plumbing is unnecessarily complicated by such an arrangement. Therefore, there is a need for a fluid heater and storage tank assembly which is constructed in such a way so as to be essentially unlimited in fluid storage capacity, yet which has a maximum dimension so as to fit through standard doorways. In this way, essentially unlimited fluid storage capacity can be provided, even in rooms having standard size doors. To provide such a fluid heater and storage tank assembly is an object of the invention.

It has also been the practice in the past to construct very large storage tanks and hot water heaters only upon receiving on order from a customer. Due to the low or unpredictable sales volume and large size of such tanks (e.g. 1,000 gallons), it was not feasible to maintain an inventory of any given size. Consequently, a customer needed to wait a considerable time for his order to be, in essence, custom-made. This practice, in turn, led to considerable inefficiencies in production and labor management, since the tanks were largely hand made, and a ready supply of labor was needed to fill each order.

It is therefore a primary object of the present invention to eliminate altogether the above-described practice of manufacturing large storage tanks and hot water heaters on special order, while nevertheless enabling such tanks to be readily provided out of standard, preconstructed components which can be maintained in inventory in large quantities and assembled in short order with a minimum of labor.

Previous fluid storage structures are generally formed from single, massive, generally cylindrical storage tanks. By necessity, they need to be formed from very thick sturdy steel in order to withstand the tremendous pressures developed in the storage system. These pressures arise as a result of the quantity of fluid stored and the elevated temperatures at which the fluid is stored. Such thick steel is expensive and difficult to work with.

Another object of the present invention is therefore to provide a modular fluid storage and heating system which is constructed from a plurality of relatively compact, lightweight, inexpensive components.

SUMMARY OF THE INVENTION

The present invention satisfies the above discussed needs of the art and objects of the invention by providing a modular fluid heating and storage system which is formed from a plurality of standardized components. The system of the invention comprises a base module, which comprises a tank connected to one or more heat sources for fluid heating, and which is provided with a number of tank mounting structures which provide both plumbing and support connection to any of a plurality of modular tank components. These tank components include additional base modules, auxiliary storage tanks, heater assemblies and end caps. Each of the tank components is constructed with a flange coupling for coupling with any of the storage tanks, thereby providing a fluid storage and heating system which may be readily and immediately assembled to meet the particular needs of the user. The individual components of standard size may be maintained in inventory so that very large, special order fluid storage or heating systems may be readily assembled in a short time with minimum labor. Each of the tank components is compact in size and may pass through conventional halls and doorways, thereby permitting assembly of the storage and heating system at the user's site. Due to the modular nature of the system, the heating and storage capacity of the system may be modified to meet the changing needs of the user without having to replace the entire system. Instead, one tank component, such as an end cap, may be replaced by another tank component, such as an auxiliary storage tank, to provide for increased storage capacity for the system. If additional heating is required, an additional heater assembly may be substituted for, e.g., an end cap. Therefore, the present invention provides a fluid storage and heating system of unprecedented flexibility in assembly.

BRIEF DESCRIPTION OF THE DRAWINGS

The invention will be better understood if reference is made to the accompanying drawings, in which:

FIG. 7 shows details of the fuel burner heat transfer arrangement;

FIG. 8 shows a cross-sectional view through the fuel burner and heat transfer tube assembly of FIG. 7;

DESCRIPTION OF THE PREFERRED EMBODIMENTS

I. First Embodiment

Figure 1:
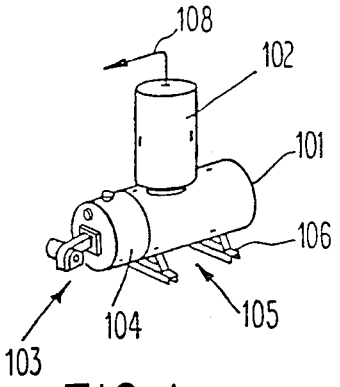
FIG. 1 shows a basic unit of a first embodiment of the invention wherein a singular modular storage tank is attached to a base assembly.

FIG. 1 shows an embodiment of the invention in which a single additional storage tank 102 is attached to a base unit 101. The base unit 101 comprises a heat source 103, shown as a fuel burner assembly. The fuel may be gas or oil; electric heaters are also within the invention. The heat source 103 is affixed to an end member 104, which contains a fluid inlet 15 (see FIG. 7). This end member 104 is attached to a tank 105, which in turn is supported on conventional support members 106. The tank 102 is added to the base member 101 by a connection which is detailed below in FIG. 6. The connection between the base member 101 and the tank 102 provides physical support as well as plumbing connections thereto. Water having been heated by burner assembly 103 is then stored in both tanks 101 and 102 and withdrawn, preferably from the top of tank 102 as indicated at 108; in this way, the hottest fluid, which rises due to convection, is always that which is withdrawn.

The tanks 101 and 102 in this and the other embodiments may, for example, typically be provided in two sizes, which are, respectively, 27 inches in inside diameter, and 31 inches in diameter over the insulation, to conform to conventional doors which are typically 32 inches wide, or 39 inches in inside diameter, and 43 inches in diameter over the insulation, which may be used for areas where somewhat wider doors, e.g. walk-out basement doors and the like, are available. other diameters are of course within the invention, and can be selected on the basis of the particular application. The lengths of the tanks are arbitrary to provide for a wide range of available tank capacities.

Figure 2:
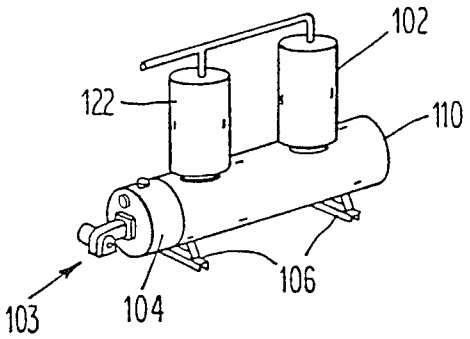
FIG. 2 shows an embodiment of the invention with two storage tanks attached to a base assembly.

FIG. 2 shows a second embodiment of the invention having similar reference numerals where applicable. In this case, two tanks 102 are provided and the base tank 110 is accordingly lengthened to accommodate the two tanks 102.

Figure 4:
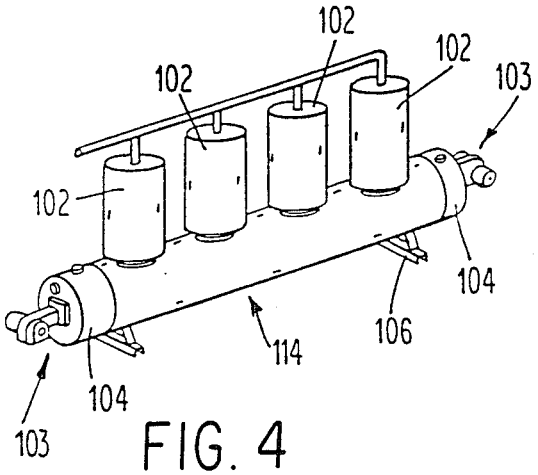
FIG. 4 shows an embodiment in which four storage tanks are attached to a base assembly, and in which the base assembly additionally comprises dual heater units.
Figure 3:
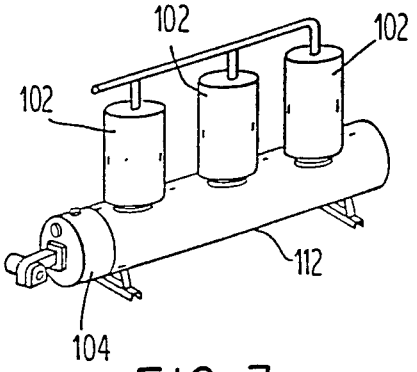
FIG. 3 shows an embodiment in which three storage tanks are attached to a base assembly.

FIGS. 3 and 4 show additional embodiments of the invention in which three and four additional vertical storage tanks 102 are provided. FIG. 4 also shows how dual burner units 103 can be provided as needed to heat the large volumes of fluid which can be stored in an assembly of this size. Again, the base storage tank 112 is sized in the embodiment of FIG. 3 to accommodate three vertical storage tanks 102, while in FIG. 4 the base storage tank 114 has four additional tanks 102 attached and hence is provided with four mating structures.

It will be appreciated that the additional tanks 102 can be added as necessary, and that their capacities can be chosen as needed, due to the modular nature of this first embodiment of the system of the invention. Provided in tables I and II are examples of the variety of fluid storage configurations and capacities that are available in the tank system of the first embodiment of the present invention.

Table I comprises three tables, labeled I(a)-(c). Across the top of each table appear the Roman numerals I-IV. These correspond to the embodiments of FIGS. 1-4, respectively. In the columns beneath them are the total storage capacities of the overall assemblies according to the embodiments of FIGS. 1-4. The capacities of the lower tanks are shown in the leftmost column, ranging from 125 gallons to 375 gallons. Thus, the 900 gallon total capacity under III in Table I(c) refers to an assembly of a lower tank 11 feet long having three 175 gallon upper tanks affixed thereto. The upper tanks in Tables I(a)-(c) are respectively of 125, 150 and 175 gallon capacity each. All of the lower tanks in Table I are of 27 inch vessel inside diameter and 31 inches insulated diameter, so as to pass through a standard 32 inch door. The numbers 3', 5', 8', 11' indicate the length of the overall assembly.

TABLE II

| Lower Tank | | | | | |
|---|---|---|---|---|---|
| Capacity | Length | I | II | III | IV |
| | (a) 250 Gal. Per Upper Tank | | | | |
| 250 | 3' | 500 | | | |
| 525 | 7' | 775 | 1025 | | |
| 800 | 11' | 1050 | 1300 | 1550 | |
| 1075 | 15' | 1325 | 1575 | 1825 | 2075 |
| | (b) 325 Gal. per Upper Tank | | | | |
| 250 | 3' | 575 | | | |
| 525 | 7' | 850 | 1175 | | |
| 800 | 11' | 1175 | 1500 | 1825 | |
| 1075 | 15' | 1400 | 1725 | 2050 | 2375 |
| | (c) 400 Gal. per Upper Tank | | | | |
| 250 | 3' | 650 | | | |
| 525 | 7' | 925 | 1325 | | |
| 800 | 11' | 1200 | 1600 | 2000 | |

TABLE II-continued

| Lower Tank | | | | | |
|---|---|---|---|---|---|
| Capacity | Length | I | II | III | IV |
| 1075 | 15' | 1475 | 1875 | 2275 | 2675 |

Table II comprises tables (a)–(c) and is generally similar to Table I except, in this case, the calculations are based on vessels of 39 inch inside diameter, which are 43 inches in diameter when insulated. In this case, the upper tanks added are of 250, 325 and 400 gallon capacity. It will be observed that the largest assembly shown, which is the embodiment of FIG. 4, is fifteen feet long and provides a total storage capacity of 2,675 gallons. This amounts to a total of over 5,000,000 BTUs of stored hear energy, in a tank which still fits through a semi-standard 44 inch door.

TABLE III

| Lower Tank Capacity/Length | Upper Tank Length 3' | 5' | 8' | 11' |
|---|---|---|---|---|
| | Capacity in Gallons | | | |
| 125/ 3' | 250 | | | |
| 175/ 5' | | 350 | | |
| 275/ 8' | | | 550 | |
| 375/11' | | | | 750 |

Figure 5:
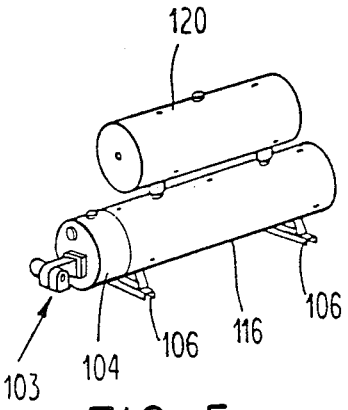
FIG. 5 shows an embodiment in which a single additional tank is added and is supported at two locations, having its axis generally horizontal rather than vertical, as in the case of the assemblies of FIGS. 1–4.

In FIG. 5 is shown yet another embodiment of the invention. In this case, the added storage tank 120 has its axis generally horizontal, as does the base tank 116, and communicates therewith by two of the mating structures which are detailed in FIG. 6. This provides a storage assembly slightly lower in height yet having an extremely high capacity while still retaining the ability to fit through a standard door. The upper and lower tanks may be of the same or different sizes. Various possible tank configurations in accordance with this embodiment are set forth in Tables III and IV below.

Table III shows the embodiment of FIG. 5 in a number of different lengths as listed. In this case, the lower and upper tanks are of similar capacity. The inside diameters of both vessels are 27 inches and the overall insulated diameters are 31 inches.

TABLE IV

| Lower Tank Capacity/Length | Upper Tank Length 3' | 7' | 11' | 15' |
|---|---|---|---|---|
| | Capacity in Gallons | | | |
| 250/ 3' | 500 | | | |
| 525/ 7' | | 1050 | | |
| 800/11' | | | 1600 | |
| 1075/15' | | | | 2100 |

Table IV is comparable, but shows capacities of the embodiment of FIG. 5 in which the vessels' inside diameters are 39 inches, and the vessels are 43 inches in diameter overall when insulated. Here, the maximum value reached for a 15 foot long assembly of two tanks of 39 inch inside diameter is 2,100 gallons.

TABLE V

| Length of Tank Assembly (inches) | Number of Tank Assemblies 1 | 2 | 3 |
|---|---|---|---|
| | GALLON CAPACITY | | |
| (a) Tanks Having an Internal Diameter of 23 Inches | | | |
| 48 | 100 | 200 | 300 |
| 78 | 150 | 300 | 450 |
| 126 | 250 | 500 | 750 |
| (b) Tanks Having an Internal Diameter of 30 Inches | | | |

TABLE V-continued

| Length of Tank Assembly (inches) | Number of Tank Assemblies 1 | 2 | 3 |
|---|---|---|---|
| | GALLON CAPACITY | | |
| 48 | 150 | 300 | 450 |
| 78 | 250 | 500 | 750 |
| 126 | 400 | 800 | 1,200 |
| (c) Tanks Having an Internal Diameter of 42 Inches | | | |
| 48 | 300 | 600 | 900 |
| 78 | 500 | 1,000 | 1,500 |
| 126 | 800 | 1,600 | 2,400 |

Figure 6:
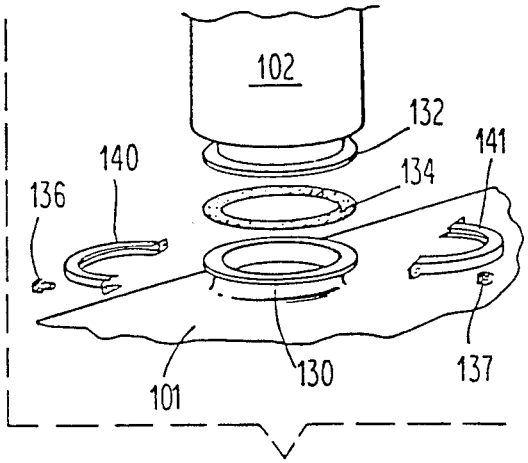
FIG. 6 shows how the connection between the base unit and the modular tanks may be made according to the invention.

FIG. 6 shows how the tanks 102 may be assembled to the base members, e.g., 101. The base member 101 is provided with a flanged orifice 130, sized to mate with a similarly flanged orifice 132 on the upper tank. An O-ring 134 is interposed between the two flanges. A flat gasket could also be used. The assembly is completed by a pair of clamps 140, 141 which are U-shaped in cross-section to clamp the two flanges together when the two clamps are held together by, e.g., bolts and nuts indicated generally at 136 and 137, respectively. The flanges could also be throughbolted to one another. In a preferred embodiment of this invention, the orifices are 18 inches in diameter.

As shown, the orifices are quite large, which is desirable both to obtain efficient connection and to provide adequate support for the upper tanks. Because the orifice are large, fluid moves from one tank to another with low friction loss compared with conventional pipe couplings. The large orifices may therefore be said to enable direct connection of tanks. By "direct connection" it is meant that the tanks are either connected end to end to form a single larger tank element or tanks are connected via a low friction loss pipe or up raised portions extending from one or both tanks. Preferably these upraised portions can support another tank.

The tanks together, because of the low friction loss direct connection, form substantially a single interior volume so that connected tanks act in essence as a single tank.

II. Burner Assembly

FIGS. 7 and 8 detail the structure of the water heater assembly which is preferably used according to invention. This assembly is the subject of Applicant's prior U.S. Pat. No. 4,465,024 and the following discussion thereof is taken from the '024 patent. Any additional disclosure from the '024 patent not expressly set forth below is incorporated herein by reference. Other heaters, including electric heaters, are within the scope of this invention.

FIG. 7 shows a fluid heater which is used in the preferred embodiment of the present invention, designated generally as 31. The fluid heater 31 is attached to a storage tank end assembly 104, having a fluid tank 104. The interior 29 of tank end assembly 104 is empty in the disassembled state shown in FIG. 1, and, when assembled, forms a storage chamber for circulation of fluid.

A combustion chamber assembly designated generally as 31 in FIG. 7 has a submersible portion which is adapted to be received within opening 19 in tank end assembly 104. The submersible portion of the assembly includes a submersible combustion chamber portion 33 comprising a cylindrical elongated member having an open end 35 and having an opposite closed end 37. The combustion chamber assembly 31 also includes a mounting portion for detachably engaging the tank opening 19 for mounting the assembly 31 within the tank. The mounting portion can conveniently comprise a tube mounting flange 39 located adjacent and connected to the combustion chamber open end 35 as shown in FIG. 7. The tube mounting flange 39 is a ring like body having an opening in the central part thereof which opening coincides with the opening in open end 35 of combustion chamber 33. Flange 39 is securely affixed to chamber 33 as by welding or the like.

As seen in FIG. 7, the combustion chamber assembly 31 also includes a plurality of curved fire tubes 41 each of which has an end 43 which communicates with combustion chamber 33 through closed end 37 (see FIG. 8) and which has an opposite end 45 which extends through the opening 19 when in place on tank end assembly 104. Each of curved tubes 41 is characterized in that at least a portion 47 of the length thereof is generally U-shaped. The configuration shown in FIG. 1 has a combustion chamber 33 which extends substantially the length of the curved fire tubes 41 creating a long leg 49 running along the exterior of the combustion chamber 33 and separated by U-shaped portion 47 from a short leg 51 (see FIG. 8) which joins and extends through closed end 37.

The ends 45 of curved tubes 41, as shown in FIG. 7, preferably extend to the tube mounting flange 39 and communicate through flange 39 by means of openings 53 with the tank exterior when the assembly 31 is received within the opening 19. The tube ends 45 are fixedly secured to flange 39 as by brazing the tube ends on the front and back sides of flange 39. Other assembly processes, such as rolling and welding, may also be employed. Although a small number of curved tubes 41 are shown in FIG. 1 for simplicity, a greater number of tubes and openings can be used in practice. Although steel can be used in constructing the curved tubes 41, other acceptable materials include copper, 90-10 copper-nickel alloy, titanium, and stainless steel.

The combustion chamber assembly 31 can be mounted on the tank end assembly 104 by providing a tank mounting flange 55 comprising a cylindrical ring which is fixedly connected to the tank exterior so as to circumscribe the opening 19 and to extend outwardly therefrom. The end 57 of tank mounting flange 55 can be provided with a plurality of threaded bores 59 which are suitably spaced to be alignable with matching bores 61 in tube flange 39, whereby the combustion chamber assembly 31 can be bolted to the tank mounting flange 55. In this way, the combustion chamber assembly 31 is removable from the tank end assembly 104 by detaching the tube mounting flange 39 and sliding the assembly out of the opening 19. Because of the arrangement of opening 19 in the vertical sidewall 21, the combustion chamber assembly 31 is mounted in a horizontal fashion with the longitudinal axis of the assembly 31 parallel to the plane of the support area 27.

As shown in FIG. 7, a flue collector 63 is mounted on the tube mounting flange 39 and has an opening which communicates with the combustion chamber portion 33 and an annular chamber 67 which communicates with the fire tubes 41 by means of openings 53 in flange 39. A circumferential lip 69 joins the base 71 of annular chamber 67 and is provided with a plurality of holes 73 which are alignable with bores 61 in flange 39 and threaded bores 59 in tank mounting flange 55 whereby flue collector 63 can be mounted on the exterior of the tank end assembly 104. Flue collector 63 has a flue outlet 75 which communicates with the interior of annular chamber 67 and which can be connected to a flue pipe for carrying away waste gas as will be presently described.

The opening 65 in flue collector 63 which communicates with chamber 33, as seen in FIG. 7, is provided in a circular partition 77 formed in the internal diameter 79 of the exterior portion of annular chamber 71. Partition 77 can be provided with a plurality of threaded lugs 81 which are fixed about the circumference of opening 65 and extend outwardly in normal relation thereto. A suitable heat source such as a burner means is mounted on the flue collector 63 and communicates with the flue collector opening 65 for supplying heat to tank 13.

The heat source, as shown in FIGS. 7 and 8, can comprise a burner nozzle 83 from a forced draft burner which has a circumferential ring 85 provided with a series of holes 87 which mate with and receive lugs 81 on partition 77 for bolting the nozzle 83 onto the flue collector 63. In this way, the nozzle burner opening 89 can communicate with the combustion chamber 33 whereby heat from the burner passes through the interior of the submerged combustion chamber 33 and through the fire tubes 41, thus further heating the water, into the annular chamber 67 of the flue collector 63, and out the flue outlet 75 to be exhausted. Preferably, the nozzle burner 83 is suitably constructed to work against a positive pressure.

The operation of the present fluid heater will now be described in greater detail. The fluid heater is first assembled by mounting the fire tube assembly 31 within opening 19. The bores 61 in the fire tube flange 39 are aligned with the threaded bores 59 in tank flange 55 and the flue collector 63 is positioned over flange 39 with the flue outlet 75 directed upwardly with respect to the vertical side walls 21. Bolts through the holes 73 in circumferential lip 69 of flue collector 63 and fire tube flange 39 attach the combustion chambers assembly to the tank flange 55. The nozzle burner 83 is then bolted into place on partition 77 in flue collector 63 and water is introduced into the tank interior 29 through water inlet 15. In the configuration shown in FIG. 7, the burner is fixed to introduce hot gas into the combustion chamber 33 to provide a positive pressure within chamber 33, with the flue gasses passing out the curved fire tubes 41 and through the flue collector annular chamber 67 to the flue outlet 75 to be exhausted from the system. The burner 83 is switched off and on as needed to maintain the desired temperature level of the fluid contained in the tank in response to a conventional temperature control circuit of the type known in the art and familiar to those in the fluid heater industry.

III. Modularity of Invention

Figure 9:
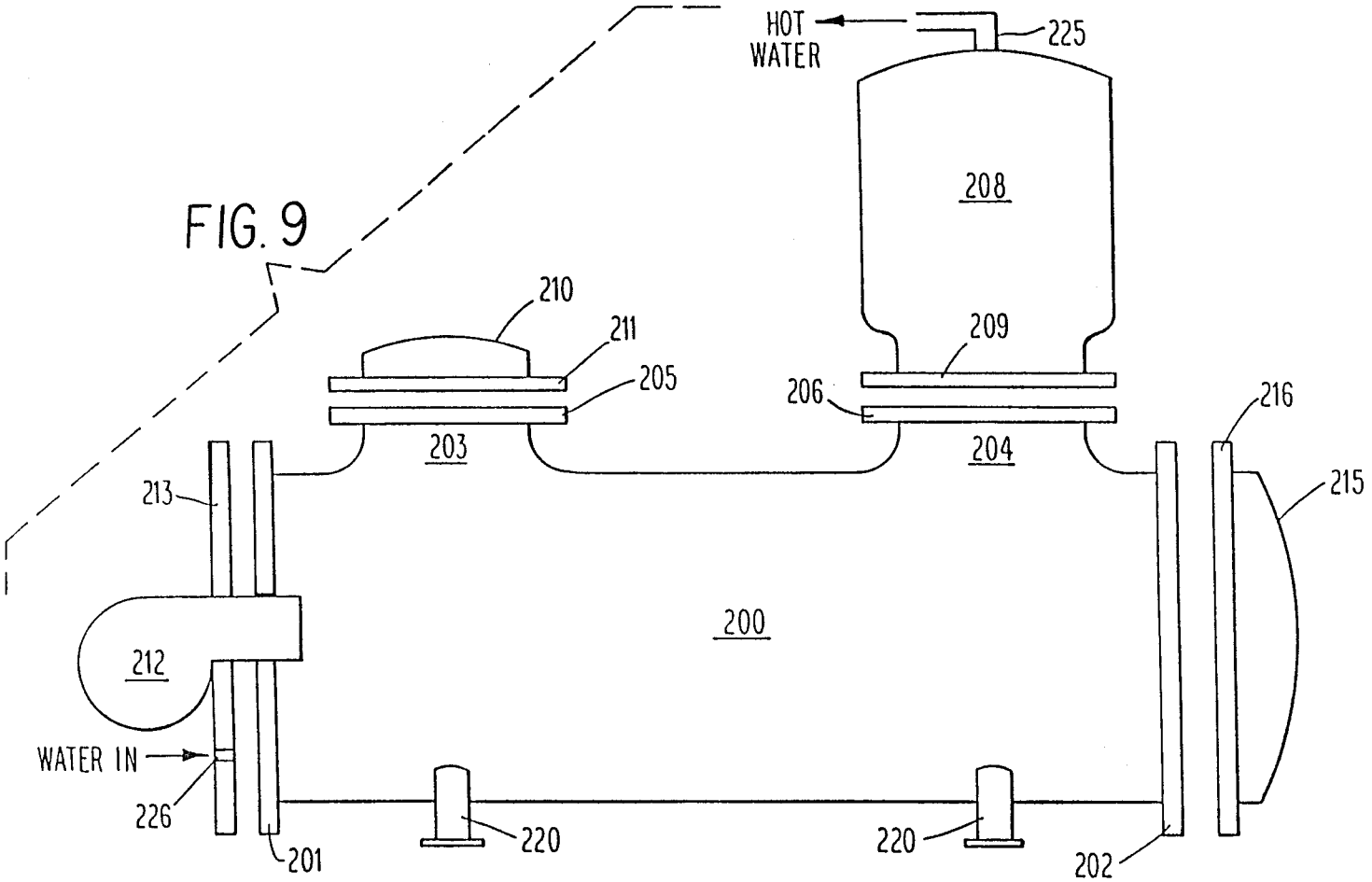
FIG. 9 is a diagrammatic side view illustrating another embodiment of the modular hot water heater and storage tank assembly of the invention.

FIG. 9 shows another embodiment of the invention, corresponding most closely to FIG. 2. A base tank 200 is shown which may in essence comprise a section of cylindrical tubing having added thereto flanges 201, 202, and being formed by conventional metalworking processes to form upraised portions 203 and 204 to accept additional flanges 205 and 206. To these flanges may be added storage tanks 208 of any size desired, by way of additional flanges 209, or they simply may be capped by way of a cap member 210 and a flange 211. At the ends of the cylindrical base tank 200 are added a heat source 212, which preferably is a burner as disclosed above in connection with FIGS. 7 and 8, but which may also comprise an electric heater of conventional type. Again, the connection is made by way of a flange 213. The other end of the tank may be capped as shown in FIG. 9 by a cap member 215 and another flange 216, or may have added thereto another burner assembly comparable to item 212. The tank assembly is completed by feet 220, fluid outlet 225, preferably as shown at the top of the tank 208 to ensure withdrawal of the hottest fluid, and by fluid inlet 226.

IV. Second Embodiment

FIGS. 10–15 depict individual modular components of a second preferred embodiment of the fluid storage and heating system of the present invention. A plurality of standard-sized modular components are provided to permit fabrication of a fluid storage system having virtually any desired storage capacity. Selection of appropriate components permits immediate custom manufacture of a fluid storage system from individual, preassembled elements, as will be described in greater detail below.

Figure 10:
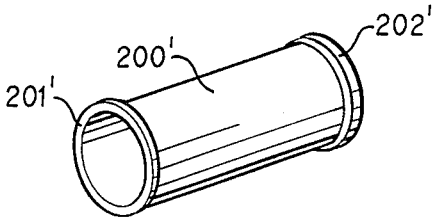
FIG. 10 depicts another embodiment of a modular fluid storage tank that is adapted for coupling with any of a plurality of modular tank components.

FIG. 10 depicts a storage tank 200' having flanges 201' and 202' at opposite ends thereof. Flanges 201' and 202' provide for coupling with any of a plurality of modular tank components which are depicted in FIGS. 10–15.

Figure 11:
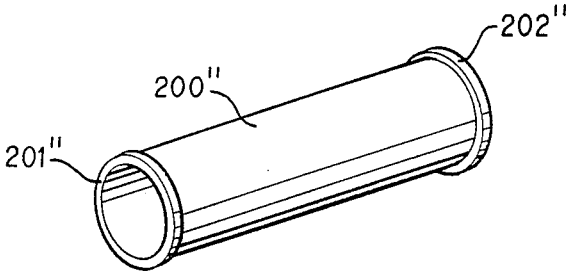
FIG. 11 depicts a modular fluid storage tank similar to that depicted in FIG. 10 having a different fluid storage capacity.

FIG. 11 illustrates a storage tank 200'' which is similar to the tank depicted in FIG. 10, with the exception of size. Tank 200'' provides for greater storage capacity than does tank 200' by virtue of its greater length. The diameter of the two tanks are preferably the same to provide for standardization and to facilitate coupling of various modular tank components to be described in greater detail below. However, tanks of different cross-sectional width also fall within the practice of the present invention. Tank 200'' includes flanges 201'' and 202'' for coupling with any of a plurality of other modular tank components.

Figure 12:
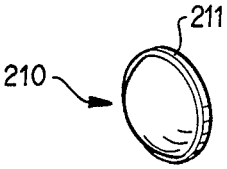
FIG. 12 depicts a modular cap unit for sealing off a tank opening.

In FIG. 12 there is depicted a removable cap 210 having a flange 211 for coupling with one of the flanges 201', 202', 201'' and 202'' of the tanks 200', 200'' or any other correspondingly-sized coupling flange. Removable cap 210 is provided to seal an end or a side of a tank having a corresponding flange. Details of flange coupling are provided hereinbelow.

Figure 13:
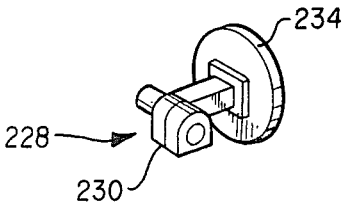
FIG. 13 depicts a modular burner assembly for coupling with one of the modular fluid storage tanks of the present invention.

FIG. 13 depicts a heater assembly 228. Heater assembly 228 comprises a heater 230 having a flange 234 for coupling with a corresponding flange of another modular tank member such as tank 200'or 200''. The heater assembly 228 provides for heating of the tank contents and seals an end or side of the tank in a manner similar to that performed by the cap 210. The heater 230 may be fueled by natural gas, fuel oil, electricity, or any other conventional source of heat energy.

Figure 14:
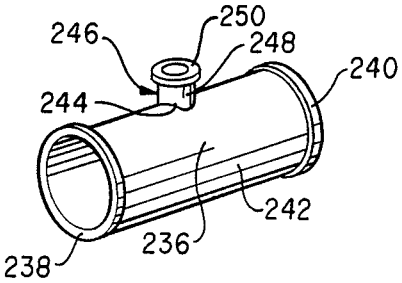
FIG. 14 depicts a modular fluid storage tank adapted for coupling with any of a plurality of modular tank components having a coupling member extending from the sidewall of the tank for coupling with a fluid storage tank positioned along the side of the tank and adjacent the coupling member.

A T-shaped modular tank 236 is depicted in FIG. 14. Tank 236 is open-ended and includes a pair of flanges 238 and 240 at each tank end. The sidewall 242 of tank 236 includes an opening 244 from which extends coupling member 246. Coupling member 246 comprises an outwardly extending shaft 248 and a flange 250 positioned adjacent the outer end of the shaft. The coupling member provides for fluid communication with another one of the modular tank components such as cap 210, heater assembly 228, or a coupling member of another tank.

Figure 15:
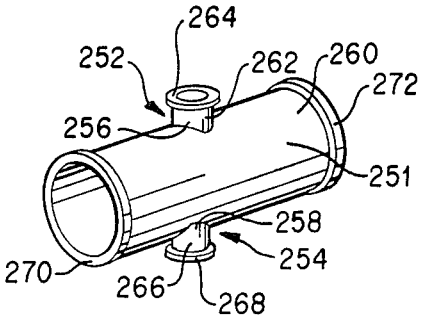
FIG. 15 depicts a modular fluid storage tank similar to that illustrated in FIG. 14 and having first and second coupling members extending from the tank sidewall for coupling with fluid storage tanks positioned adjacent the tank sidewall and the coupling members.

FIG. 15 depicts another tank structure 251 having a pair of coupling members 252, 254 extending outwardly from openings 256, 258 formed in opposite sides of tank sidewall 260. Coupling member 252 include an outwardly extending shaft 262 and a coupling flange 264 positioned adjacent the outer end thereof. Similarly, coupling member 254 includes an outwardly extending shaft 266 having a coupling flange positioned adjacent the outer end thereof. The coupling members 252, 254 provide for coupling with any of the various modular tank components, such as caps 210, heater assemblies 228, or tanks 200', 200'', 236 or 251. Flanges 270 and 272 at opposite ends of the tank 251 also provide for coupling the tank to any of the variety of tank components.

V. Modularity of the Second Embodiment

The modularity of the second embodiment of the invention is illustrated in FIGS. 16–19, in which various combinations of the modular tank components of FIGS. 10–15 are depicted. Modularity arises in part from the provision of coupling flanges on each of the various individual modular tank components. By virtue of the modular design, each of the tank components may be assembled to one another immediately on order from a customer to form a fluid storage and heating system having a desired fluid capacity and configuration. The modular aspect of each of the tank components also provides considerable flexibility in incorporating various system modifications in response to changing needs which may occur over time. Also, the modular nature of each of the tank components allows for fabrication of a fluid storage and heating system on site from a plurality of tank components dimensioned to permit passage through conventional doorways and halls.

Figure 16:
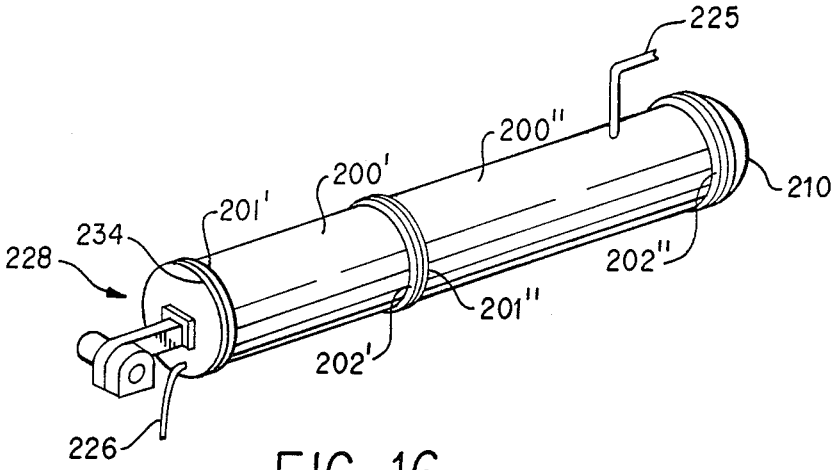
FIG. 16 depicts the modular aspect of the invention in which an auxiliary storage tank is axially coupled to a base tank.

With reference to FIG. 16, a first system component in the form of tank 200' is positioned in axial alignment with tank 200''. Flange 202' of tank 200' is coupled to flange 201'' of tank 200'' to provide fluid communication between the two tanks. The manner of coupling will be described in greater detail hereinafter. Heater assembly 228 comprising heater 230 and connecting flange 234 is coupled to the other end of the tank 200' through corresponding connecting flanges 201' and 234. As discussed above, the heater may be powered by any conventional fuel, such as natural gas, electricity or fuel oil. The other end of the tank 200'' is coupled through flange 202'' to another auxiliary system component in the form of tank sealing means such as cap 210 through the cap flange 211. However, as will be discussed below, another auxiliary tank component such as heater assembly 228 or tank 200' or 200'' may be substituted in place of the cap 210 to provide for further expandability of the heating and storage system as the needs of the user require. For the purpose of illustration only, tank 200' preferably has a length of approximately 48 inches and an internal diameter of either 23, 30 or 42 inches. Tank 200'' preferably has a length of approximately 78 inches and an internal diameter of either 23, 30 or 42 inches. Modular tanks formed with these dimensions are well suited for passage through halls and standard sized doorways often-times present at the installation site. Fluid storage and heating systems of a variety of capacities may be constructed using, for example, the 48 inch and 78 inch long tanks as system building blocks.

Fluid inlet 226 and heated fluid outlet 225 are also included as noted above to provide for fluid flow into and out of the storage and heating system. Preferably, fluid inlet 226 feeds into tank 200' adjacent heater assembly 228 to enhance fluid heating.

Figure 17:
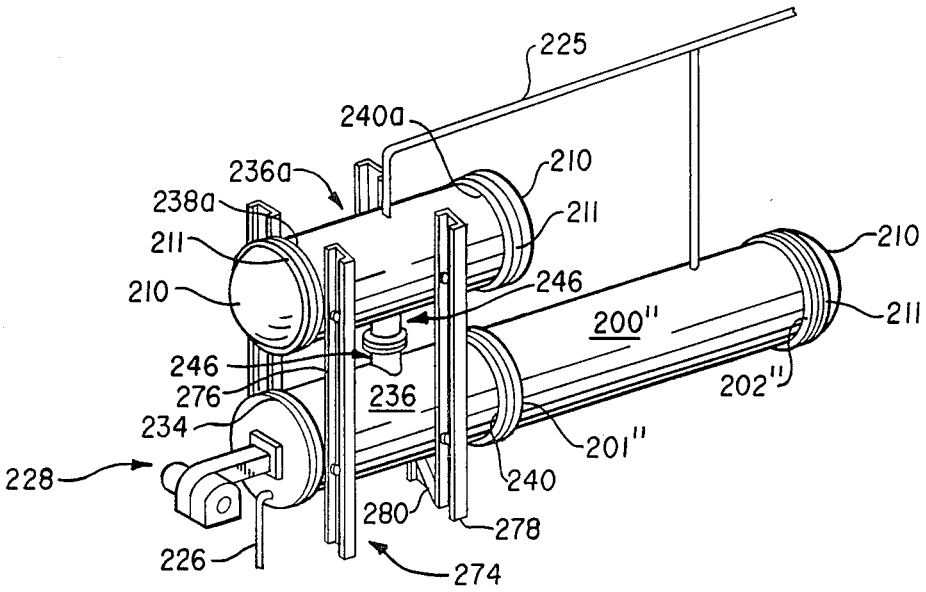
FIG. 17 depicts an embodiment in which two auxiliary tanks are coupled to a base tank; one auxiliary tank being coupled to an end of the base tank and the other auxiliary tank being coupled to a side of the base tank.

FIG. 17 shows another arrangement for the modular fluid storage and heating system. Two T-shaped tanks 236 and **236*a* are coupled to one another at their respective coupling members 246. Each coupling member 246 includes a coupling flange 250 mounted at the end of a shaft 248. Shaft 248 extends substantially transversely and outwardly from the sidewall 242 a sufficient distance so that various tank components do not interfere with one another when they are included in the modular fluid storage and heating system. Flange 238 of the tank 236 is coupled to heater assembly 228 through flange 234. Opposite tank flange 240 is coupled to tank 200'' at flange 201''. Flange 202'' of tank 200'' is coupled to cap 210 through cap flange 211. Alternatively, other auxiliary tank components having suitable coupling flanges may be substituted therefor. Thus, by virtue of the modularity of the system provided by the arrangement of coupling flanges, whereby any of a number of tank components may be joined to one another, fluid storage systems may be provided which are adaptable to the particular needs of the user, even as these needs change with time to require larger storage capacity or faster recovery times. Increased storage capacity is achieved simply by replacing, for example, a component such as cap 210 with any one or more of the tanks 200', 200'', 236 or 251. Fluid inlet 226 feeds into tank 236 adjacent heater assembly 228 to provide fluid to be heated and stored in the tank. Heated fluid circulates to tanks 200'' and 236*a* and exits therefrom through outlet 225**.

Support structure 274 may be provided to support the vertical arrangement of tanks 236 and **236*a* in order to maintain the tanks in the preferred vertical configuration. A vertical tank stacking arrangement is preferred because this arrangement conserves floor space and utilizes the inherent characteristic of a warm fluid to separate from a cooler fluid by rising therefrom, thereby permitting the burner assembly to warm primarily cooler fluid entering the tank 236 through the fluid inlet 226. Support structure 274 includes a plurality of paired, opposed vertically extending beams 276 coupled to one another at their respective feet 278 by transverse supports 280. Each tank is connected to each beam 276 by a securing member such as a bolt 281 fixed to the exterior wall of the tank which extends through a correspondingly shaped channel 281*a* formed in the beam 276. Additional support is provided by the interconnected coupling member 246**.

Figure 18:
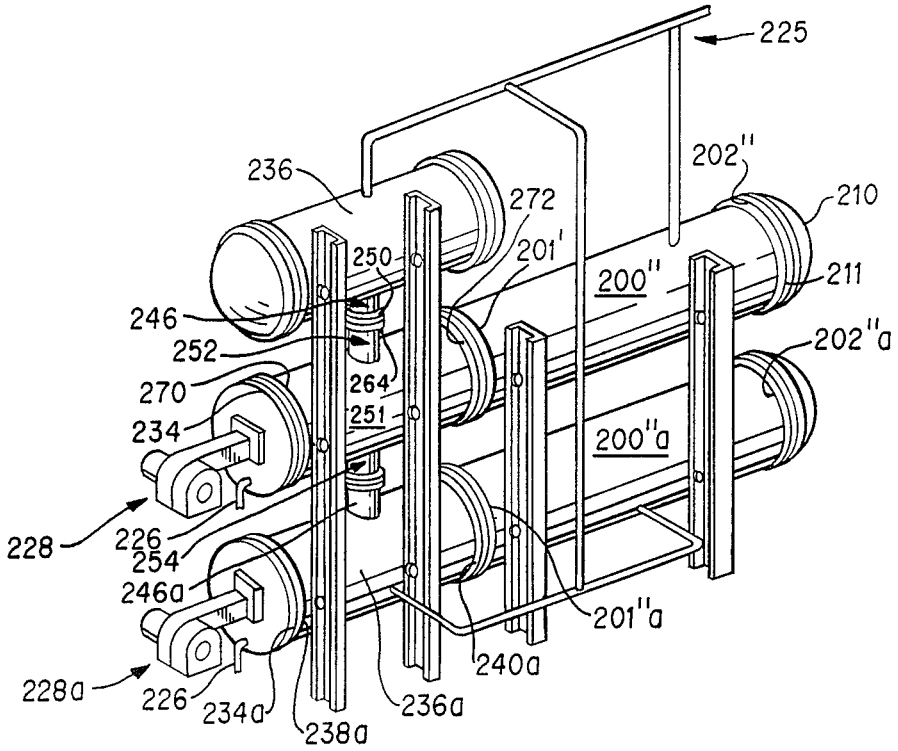
FIG. 18 depicts an embodiment wherein a base tank is coupled along its side to two other base tanks and an auxiliary tank along one of its ends;.

FIG. 18 depicts yet another configuration for the modular fluid storage and heating assembly of the present invention. In this figure, tank 251 includes a pair of opposed coupling members 252 and 254 for coupling with T-shaped tanks 236 and **236*a*, respectively. Heater assembly 228 is connected to the tank 251 through flanges 234 and 270 to provide heat to fluid contained within the tank assembly. Supplemental heater assemblies may also be provided, as will be discussed below. The opposite end of tank 251 is coupled by flange 272 to tank 200'' at flange 201''. Flange 202'' provides for coupling with another modular tank component, such as cap 210 through flange 211**, as shown in the drawing.

Coupling member 252 provides for coupling of tank 251 at its upper end with T-shaped tank 236 through corresponding coupling member 246 and flanges 264 and 250, respectively. Flange 264 is positioned at the end of shaft 262, which extends radially outwardly from sidewall 260. Fluid communication between tanks 251 and 236 is thereby provided through corresponding coupling members 252 and 246 to provide for fluid storage capacity beyond that of tank 251 alone. The ends of tank 236 include coupling flanges 238 and 240 for coupling with further modular tank components. Coupling with caps 210 through cap flange 211 in the manner discussed above is depicted. However, it is understood that due to the modularity of the fluid storage system of the present invention, any of the tank components discussed above could be coupled to the ends of the tank 236 in place of caps 210.

Coupling member 254 at the lower end of tank 251 provides for coupling with another tank, such as T-shaped tank **236*a*, through corresponding member 246*a* in the manner discussed above. End flanges 238 and 240*a* provide for coupling to further tank components. Flange 238*a* is coupled to burner assembly 228*a* through flange 234*a* to provide for further heating of the fluid contents of the storage system. Flange 240*a* is coupled to tank 200''*a* at flange 201''*a* to further increase storage capacity of the system. Opposite flange 202''*a* of tank 200''*a* is coupled to cap 210, but may be coupled to another tank component such as a burner assembly 228 or another storage tank in accordance with the needs of the user. Fluid inlet 226 and heated fluid outlet 225 are provided in a conventional manner to permit fluid to circulate through the fluid storage system in the manner discussed above. Support structure 274** is provided to support each of the preferred vertical arrangements of storage tanks in the manner discussed above.

VI. Flange Coupling

Figure 19:
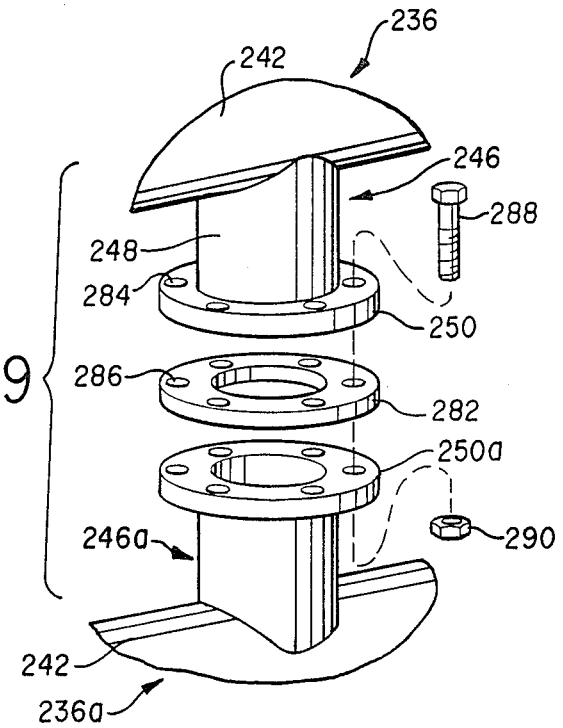
FIG. 19 depicts another coupling arrangement for coupling the tanks and other modular storage tank components to one another.

With reference now to FIG. 19, another preferred arrangement is shown for coupling the various modular tank components to one another. Two tanks 236 and **236*a* are shown having their respective coupling members 246 and 246*a* axially aligned for coupling with one another. Although coupling of the flanges of coupling members 246 and 246*a* is depicted, it is understood that the coupling principles are equally applicable to the coupling together of any of the flanges of the modular tank components. Flange 250 is positioned at the end of shaft 248 which extends substantially transversely and outwardly from sidewall 242 of the tank 236. Similarly, flange 250*a* is positioned on the outer end of shaft 248*a*, which extends substantially transversely and outwardly from sidewall 242*a* of tank 236*a*. Shafts 248 and 248*a* may be welded to the respective tank sidewalls 242, 242*a* or formed in any suitable manner. Preferably, flanges 250 and 250*a* are positioned adjacent the ends of corresponding shafts 248, 248*a* such that they are oriented substantially parallel to the tank to which they are connected. Typically, the flanges 250 and 250*a* are welded to their respective shafts, but other known securing arrangements may also be utilized. Gasket or sealing member 282 is interposed between opposed flanges 250 and 250*a*** to provide a liquid-tight seal upon coupling of the flanges to one another.

Each of the flanges 250 and **250*a* includes an arrangement of spaced apertures 284 extending transversely therethrough which may be aligned with corresponding apertures of the opposed flange. The gasket or sealing member 282 is provided with apertures 286 corresponding to the apertures 284 formed in the flanges 250 and 250*a*. Flange coupling members, such as bolt members 288, extend axially through the paired apertures of the opposed flanges and the interposed gasket or sealing member to couple the flanges 250, 250*a* to one another and to provide for fluid communication between the tanks 236 and 236*a*. Nut members 290 extend over the respective ends of the bolt members 288** to secure the flange couplings provided thereby.

VII. Advantages of the Modular Arrangement of Tank Components

The modular nature of the system of the invention thus provides unprecedented flexibility in assembly of fluid storage and heating systems. In essence, a number of basic units, such as tanks 200', 200'', 236 and 251, heater assemblies 228, and caps 210 may be manufactured as inventory items; when a specific volume storage assembly is ordered, it is a straightforward matter to select the various parts needed from inventory to construct the desired tank storage or hot water heater assembly.

A further advantage of the modular nature of the system is that much thinner steel may be used for constructing the components of the system. For example, whereas the thickness of the tank walls and caps in a typical pressurized 600-gallon conventional cylindrical storage or water heater or boiler tank structure is on the order of $\frac{5}{8}$ inch and $\frac{3}{4}$ inch, respectively, their corresponding thicknesses in the modular system of the present invention is only on the order of 3/16 inch and $\frac{1}{4}$ inch, respectively. The modular tank components of the present invention are able to use thinner steel than prior art tank components because the modular tank components individually are of a much smaller size than the prior art components. Because prior art fluid storage structures were generally formed from single, massive storage tanks, they by necessity had to be formed from very thick, sturdy steel in order to withstand the tremendous pressures developed in the storage system. These pressures arise as a result of the quantity of fluid stored and the elevated temperatures at which the fluid is stored. Because the modular tank units of the present invention are considerably smaller in size than the prior art structures, yet can be assembled to produce a fluid storage facility of much greater capacity than heretofore available, thinner steel may be used in constructing the tanks. Therefore, besides providing a significant degree of flexibility in designing and constructing a fluid storage system, the present invention affords greatly reduced manufacturing costs due to the use of less material as well as the provision of mass-produceable, standardized components.

In addition, the tanks may be constructed having standardized dimensions such as tank diameters and lengths to provide for mass rather than customized production of fluid storage and heating systems. The construction of components of this type is significant because it permits fabrication of extremely large storage systems from stock rather than from special order components, thereby greatly reducing the time and expense necessary to construct the storage system. For example, FIGS. 1–7, 9 and 16–18 depict various tank arrangements for storage systems consistent with the practice of the present invention. As is clearly shown in these drawings, the modular nature of the couplings of the various tank components permits one to construct a fluid storage and heating system of extremely large, e.g., several thousand gallon fluid capacity, from components which are dimensioned to fit through a variety of standardized doorways. Because assembly of the fluid storage and heating system may occur at the installation site, one is not limited to a fluid storage system defined by the dimensions of the corridors and doorways of the facility in which the system is to be installed, as is the case in prior art storage tank systems.

In the preferred embodiment, the tanks and attached tank components are depicted in a vertical orientation, with the fluid outlet at the top of the uppermost tanks in the system, so that convection will ensure that the hottest fluid is withdrawn. Side-by-side arrangement would also be possible if a large-enough plumbing connection were made between the tanks. Similarly, while cylindrical tanks are preferred for ease of manufacture, other shapes are possible.

The advantages discussed above become more apparent when quantified and arranged in tabular form. For example, Table V is illustrative of the variety of tank configurations and capacities that are possible in fluid storage and heating systems in accordance with the embodiments depicted in FIGS. 16–19. The table is divided into three sections, labeled (a)–(c), wherein (a) represents fluid volume capacities of systems formed from tanks having an internal diameter of 23 inches; (b) represents fluid volume capacities of systems formed from tanks having an internal diameter of 30 inches; and (c) represents fluid volume capacities of systems formed from tanks having an internal diameter of 42 inches. In each of the tables, fluid volume capacities are provided for systems having from 1–3 tank assemblies, wherein a tank assembly preferably represents one or two tanks having a longitudinal length of either 48, 78 or 126 inches. Single tanks of 48 or 78 inch length may be provided, whereas the 126 inch long assembly is formed from one 78 inch tank and one 48 inch tank arranged end-to-end. The designation "number of tank assemblies" represents the number of tank assemblies comprising the storage system.

TABLE VI

| External Tank Diameter (inches) | Minimum Door Frame Width (inches) |
|---|---|
| 23 | 30 |
| 30 | 36 |
| 42 | 48 |

Table VI illustrates the relative tank/minimum door frame dimensions through which the three preferred tank widths of the present invention may pass in order to permit for construction of a modular fluid storage and heating system on the premises. Each of the preferred tanks of the diameters specified in the table is available in two preferred tank lengths, 48 inches and 72 inches.

The minimum door frame widths listed in the table below provide for 2 inches of clearance on each side of the tank in order to accommodate any tank maneuvering which may be necessary to pass the tank through the door frame.

TABLE I

| Lower Tank | | | | | |
|---|---|---|---|---|---|
| Capacity | Length | I | II | III | IV |
| | (a) 125 Gal. Per Upper Tank | | | | |
| 125 | 3' | 250 | | | |
| 175 | 5' | 300 | 425 | | |
| 275 | 8' | 400 | 525 | 650 | |
| 375 | 11' | 500 | 625 | 750 | 875 |
| | (b) 150 Gal. per Upper Tank | | | | |
| 125 | 3' | 275 | | | |
| 175 | 5' | 325 | 475 | | |
| 275 | 8' | 425 | 575 | 725 | |
| 375 | 11' | 525 | 675 | 825 | 975 |
| | (c) 175 Gal. per Upper Tank | | | | |
| 125 | 3' | 300 | | | |
| 175 | 5' | 350 | 525 | | |

TABLE I-continued

| Lower Tank | | | | | |
|---|---|---|---|---|---|
| Capacity | Length | I | II | III | IV |
| 275 | 8' | 450 | 625 | 800 | |
| 375 | 11' | 550 | 725 | 900 | 1075 |

The invention may be embodied in other specific forms without departing from the spirit or essential characteristics thereof. The embodiments described above are therefore to be considered in all respects as illustrative and not restrictive, the scope of the invention being indicated by the hereafter appended claims rather than by the foregoing description, and all changes which come within the meaning and range of equivalency of the claims are therefore intended to be embraced therein.

What is claimed is:

1. A fluid storage and heating apparatus, comprising: a first fluid storage tank having first and second mounting means, a fluid heater assembly having mounting means for mounting to either of said first or second mounting means of said first tank, and at least one second tank having mounting means for mounting with the other of said first or second mounting means of said first tank, such that said first and second tanks are in direct connection with one another and are in fluid communication with one another.

2. The apparatus of claim 1 wherein said first and second tanks are generally cylindrical.

3. The assembly of claim 2 wherein each of said mounting means of said first and second tanks and said heater assembly comprises mating flanges of generally similar dimensions whereby they can be secured together to ensure a fluid-tight connection therebetween.

4. The apparatus of claim 1 wherein said first tank physically supports said at least one second tank.

5. The assembly of claim 4 wherein each of said at least one second tanks comprises an outlet port in an uppermost portion thereof, and further comprising manifold means for connecting said outlet ports.

6. A fluid heater and storage tank assembly, comprising:

an elongated generally cylindrical lower tank having an interior for receiving fluid and at least one generally cylindrical upper tank having an interior for said lower tank being adapted to be in fluid communication with and to support and upper tank and wherein the interior of said lower tank and the interior of said upper tank together form substantially a single interior volume said lower tank further comprising means for mating with at least one fluid heater means; and wherein both ends of said lower tank are adapted to have fluid heater means mounted thereto.

7. A fluid heater and storage tank assembly, comprising:

an elongated generally cylindrical lower tank having an interior for receiving fluid and at least one generally cylindrical upper tank having an interior for receiving fluid mounted traversely to said lower tank, said lower tank being adapted to be in fluid communication with an to support and upper tank and wherein the interior of said lower tank and the interior of said upper tank together form substantially a single interior volume said lower tank further comprising means for mating with at least one fluid heater means; and wherein said fluid heater means comprises a combustion chamber, said combustion chamber being in communication with a number of tubular flue members which extend from an end of said combustion chamber disposed within said tank to a flue collector disposed outside of said tank.

8. The assembly of claim 7 wherein at least two of said fluid heater assemblies are provided within said lower tank.

* * * * *